US006396204B1

(12) United States Patent
Park et al.

(10) Patent No.: US 6,396,204 B1
(45) Date of Patent: May 28, 2002

(54) CATHODE RAY TUBE WITH ENHANCED BEAM DEFLECTION EFFICIENCY AND MINIMIZED DEFLECTION POWER

(75) Inventors: Won-Sueg Park; Bong-Woo Lee, both of Suwon-si (KR)

(73) Assignee: Samsung Display Devices Co., Ltd., Suwon-si (KR)

( * ) Notice: Subject to any disclaimer, the term of this patent is extended or adjusted under 35 U.S.C. 154(b) by 0 days.

(21) Appl. No.: 09/434,680

(22) Filed: Nov. 5, 1999

(30) Foreign Application Priority Data

Nov. 10, 1998 (KR) ..... 98-48061

(51) Int. Cl.[7] ..... H01J 29/70; H01J 31/00

(52) U.S. Cl. ..... 313/440; 313/441; 313/477 R; 313/413; 313/421; 313/423; 220/2.1 A; 220/2.1 R

(58) Field of Search ..... 313/440, 413, 313/477 R, 364, 441, 421, 423, 461, 462; 220/2.1 A, 2.1 R

(56) References Cited

U.S. PATENT DOCUMENTS 3,731,129 A * 5/1973 Tsuneta et al. ..... 313/64
5,565,731 A * 10/1996 Han ..... 313/440
5,962,964 A * 10/1999 Sano et al. ..... 313/440
6,087,767 A * 7/2000 Sano et al. ..... 313/440
6,166,484 A * 12/2000 Okuyama et al. ..... 313/440

FOREIGN PATENT DOCUMENTS

JP 58225545 * 12/1983 ..... H01J/29/86

* cited by examiner

*Primary Examiner*—Nimeshkumar D. Patel
*Assistant Examiner*—Sikha Roy
(74) *Attorney, Agent, or Firm*—Christie, Parker & Hale, LLP

(57) ABSTRACT

A cathode ray tube includes a panel with an inner phosphor screen and a rear portion. A funnel is connected to the rear portion of the panel. The funnel is sequentially provided with a body having a large-sized end and a small-sized end, and a cone portion having a large-sized end and a small-sized end. The large-sized end of the body is sealed to the rear portion of the panel. The small-sized end of body meets the large-sized end of the cone portion at a point. A neck is sealed to the small-sized end of the cone portion. The funnel is structured to satisfy the following condition: $1.16 \leqq (D/2)/\tan((\psi/2))/(FG-TN) \leqq 1.35$ where D indicates the size of an effective area of the phosphor screen, FG indicates the distance between the large-sized end of the body and a final accelerating electrode of an electron gun fitted in the neck, TN indicates the distance between the small-sized end of the cone portion and the inflection point of the funnel, and $\psi$ indicates an electron beam deflection angle.

9 Claims, 3 Drawing Sheets

CATHODE RAY TUBE WITH ENHANCED BEAM DEFLECTION EFFICIENCY AND MINIMIZED DEFLECTION POWER

FIELD OF THE INVENTION

The present invention relates to a cathode ray tube (CRT) and more particularly, to a CRT that can effectively enhance electron beam deflection efficiency.

BACKGROUND OF THE INVENTION

Generally, CRTs include a panel having an inner phosphor screen, a funnel having a cone portion, and a neck having an electron gun therein, which are sequentially connected to each other. A deflection yoke is mounted around the cone portion of the funnel to form horizontal and vertical magnetic fields there. In this structure, electron beams emitted from the electron gun are deflected through the horizontal and vertical magnetic fields from the deflection yoke, and land on the phosphor screen.

Recently, CRTs have been employed for use in highly sophisticated electronic devices such as high definition television (HDTV) and OA equipment.

On the one hand, in these applications, the power consumption of the CRT should be reduced to obtain good energy efficiency. Additionally, magnetic field leakage due to power consumption should be reduced to protect the user from a distorted magnetic field. In order to meet these requirements, it turns out that the power consumption of the deflection yoke, which is the major source of power consumption, should be reduced in a suitable manner.

On the other hand, the deflection power of the deflection yoke should increase in order to realize a high brightness and resolution of display images on the screen. Specifically, higher anode voltage is needed for enhancing the brightness of the screen and, correspondingly, higher deflection voltage is needed for deflecting the electron beams accelerated by the increased anode voltage. Furthermore, a higher deflection frequency is needed for enhancing resolution of the screen, along with the requirement of increased deflection power. In addition, in order to realize relatively flat CRTs for more convenient use, wide-angled deflection should be performed with respect to the electron beams. Wide-angled deflection also requires increased deflection power.

In this situation, there are needs for developing techniques for allowing CRTs to retain good deflection efficiency while constantly maintaining or reducing the deflection power.

Conventionally, a technique of increasing the deflection efficiency positions the deflection yoke more adjacent to the electron beam paths. The positioning of the deflection yoke is achieved by reducing a diameter of the neck and an outer diameter of the funnel adjacent to the neck. However, in such a structure, the electron beams to be applied to the screen corner portions are liable to bombard the inner wall of the funnel adjacent to the neck. (This phenomenon is usually called the "beam shadow neck" phenomenon or briefly the "BSN" phenomenon.) Consequently, the phosphors coated on the corresponding screen corner portions are not excited and it becomes difficult to obtain good quality screen images.

SUMMARY OF THE INVENTION

It is an object of the present invention to provide a CRT that can effectively enhance electron beam deflection efficiency with minimized deflection power.

This and other objects may be achieved by a CRT including a panel with an inner phosphor screen and a rear portion. A funnel is connected to the rear portion of the panel. The funnel is sequentially provided with a body having a large-sized end and a small-sized end, and a cone portion having a large-sized end and a small-sized end. The large-sized end of the body is sealed to the rear portion of the panel. The small-sized end of the body meets the large-sized end of the cone portion at a point. The meeting point of the body and the cone portion is an inflection point of the funnel. A neck is sealed to the small-sized end of the cone portion. An electron gun is fitted within the neck to produce electron beams. The electron gun has a final accelerating electrode. A deflection yoke is mounted around the cone portion of the funnel. The funnel is structured to satisfy the following condition: $1.16 \leqq ((D/2)/\tan(\psi/2))/(FG-TN) \leqq 1.35$ where D indicates the size of an effective area of the phosphor screen, FG indicates the distance between the large-sized end of the body and the final accelerating electrode of the electron gun, TN indicates the distance between the small-sized end of the cone portion and the inflection point of the funnel, and $\psi$ indicates the electron beam deflection angle.

The effective screen size D is 17 inches or more, and the electron beam deflection angle is 100 degrees or more. The cone portion may be formed either with a substantially circular sectional shape uniformly proceeding from the large-sized end to the small-sized end, or with a sectional shape varying from a circle to a non-circle shape, such as a rectangle, while proceeding from the small sized-end to the large-sized end.

DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION

Figure 1:
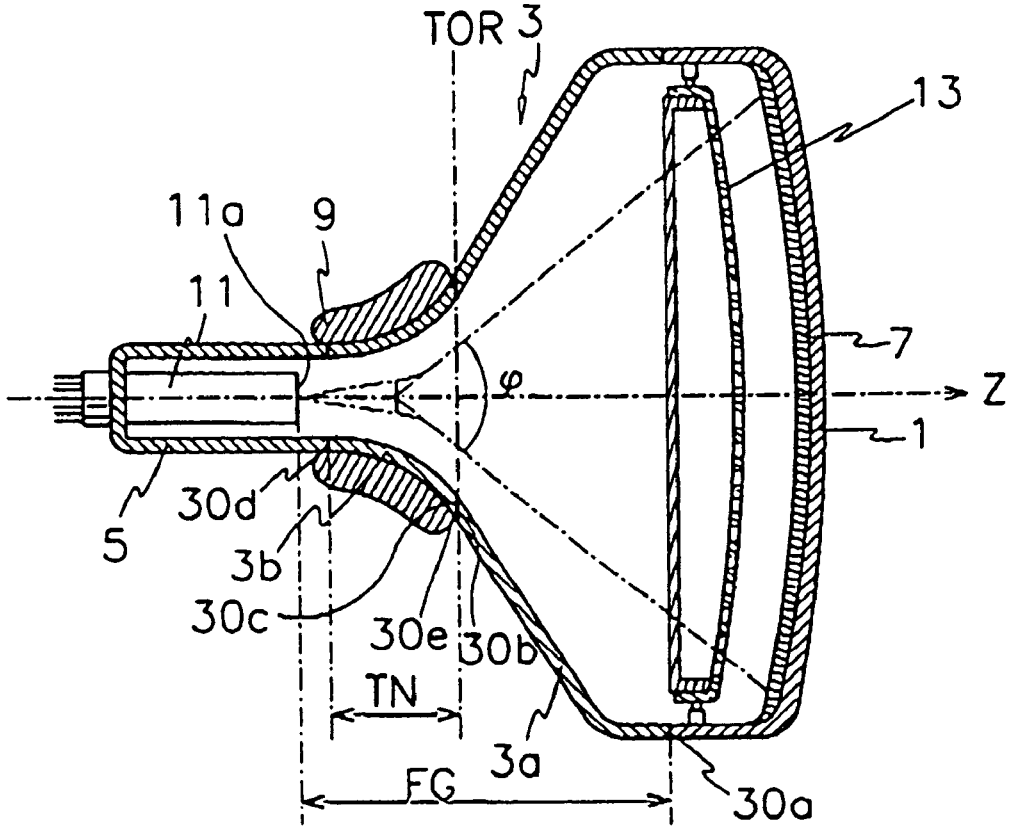
FIG. 1 is a sectional view of a CRT with a panel according to a first preferred embodiment of the present invention where the section is taken along a diagonal axis line of the panel.

As shown in FIG. 1, a first preferred embodiment of a CRT has a central axis Z in a direction, referred to hereinafter as the "tube axis". A panel 1 of the CRT has an inner phosphor screen 7 and a rear portion. A funnel 3 is connected to the rear portion of the panel 1. The funnel 3 is sequentially provided with a body 3*a* with a large-sized end 30*a* and a small-sized end 30*b*, and a cone portion 3*b*. The cone portion 3*b* of the funnel 3 also comprises a large-sized end 30*c* and a small-sized end 30*d*. The body 3*a* meets the cone portion 3*b* at a point 30*e*, and the meeting point 30*e* of the body 3*a* and the cone portion 3*b* becomes an inflection point or the so-called top of round (TOR) of the funnel 3 at which the inner curved surface of the funnel 3 changes from depression (corresponding to the body 3*a*) to prominence (corresponding to the cone portion 3*b*) The funnel 3 is sealed to the rear portion of the panel 1 at the large-sized end 30*a* of the body 3*a*. A neck 5 is sealed to the small-sized end 30 d of the cone portion 3*b*. An electron gun 11 with a final accelerating electrode 11*a* is fitted within the neck 5 to produce electron beams. A deflection yoke 9 is mounted around the cone portion 3*b* of the funnel 3.

The cone portion 3*b* of the funnel 3 has a substantially circular sectional shape uniformly proceeding from the large-sized end 30*c* to the small-sized end 30*d*.

The funnel 3 is structured to satisfy the following condition: $1.16 \leqq ((D/2)/\tan(\psi/2))/(FG-TN) \leqq 1.35$ where D indicates the size of an effective area of the phosphor screen 7, FG indicates the distance between the large sized end 30*a* of the body 3*a* and the final accelerating electrode 11*a* of the electron gun 11, TN indicates the distance between the small-sized end 30*d* of the cone portion 3*b* and the inflection point 30*e* of the funnel 3, and ψ indicates the electron beam deflection angle.

Figure 2:
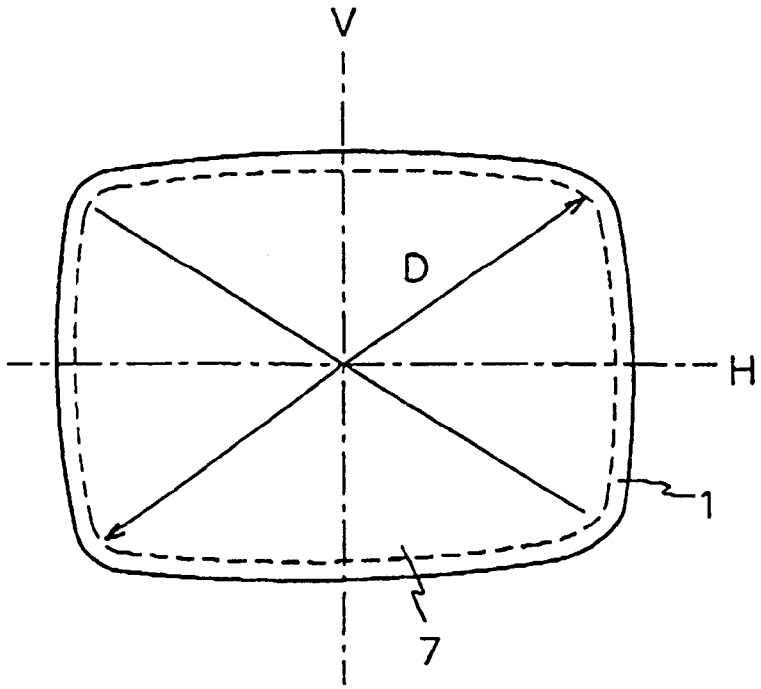
FIG. 2 is a plan view of the panel shown in FIG. 1.

As shown in FIG. 2, the effective screen size D may be defined by the distance between centers of diagonal edges of the effective screen 7 opposite to each other. As shown in FIG. 1, the electron beam deflection angle ψ may be defined as follows: where two lines are drawn from the centers of the diagonal edges of the effective area of the phosphor screen 7 opposite to each other onto the tube axis Z line such that the angle between the tube axis Z line and each of the two lines reaches half the maximum deflection angle, ψ indicates the angle between the two lines. The effective screen size D is preferably 17 inches or more, and the deflection angle is preferably 90 degrees or more.

In order to compare performance characteristics of the CRT according to the first preferred embodiment of the present invention with those of a conventional CRT, CRTs having the structural components listed in Table 1 were tested with respect to their deflection efficiency (DE) and beam shadow neck (BSN) characteristics, and the results are illustrated in Table 1 where V equals $((D/2)/\tan(\psi/2))/(FG-TN)$, ⊙ indicates a very good state, 0 indicates a good state, Δ indicates a normal state, and × indicates a poor state.

TABLE 1

| No. | D (inch) | ϕ (°) | FG (mm) | TN (mm) | V | DE | BSN |
|---|---|---|---|---|---|---|---|
| 1 | 17 | 90 | 246 | 88 | 1.37 | ○ | X |
| 2 | 18 | 90 | 255 | 88 | 1.37 | ○ | X |
| 3 | 18 | 100 | 203 | 61 | 1.35 | ⊙ | Δ |
| 4 | 20 | 100 | 240 | 78 | 1.32 | ⊙ | Δ |
| 5 | 21 | 100 | 254 | 77 | 1.26 | ○ | ○ |

As shown in Table 1, the CRTs having the above-identified structure (Nos. 3 to 5) performed well in both deflection efficiency and beam shadow neck characteristics. The conventional CRTs (Nos. 1 and 2) exhibit poor beam shadow neck characteristics. Furthermore, in the CRTs according to a first preferred embodiment of the present invention (Nos. 3 to 5), the overall CRT length can be effectively reduced.

Figure 3:
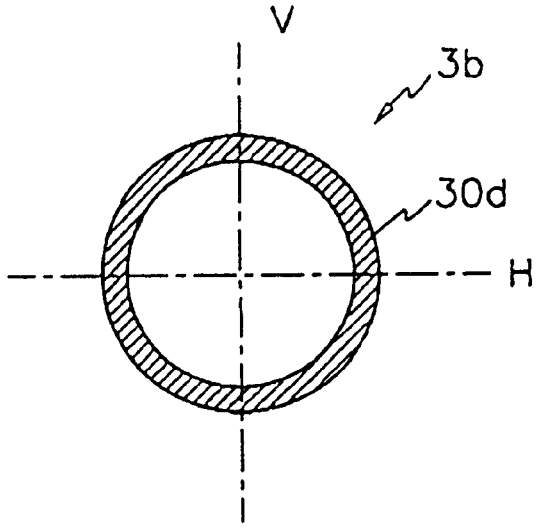
FIG. 3 is a sectional view of a cone portion of a funnel for a CRT according to a second preferred embodiment of the present invention.
Figure 4:
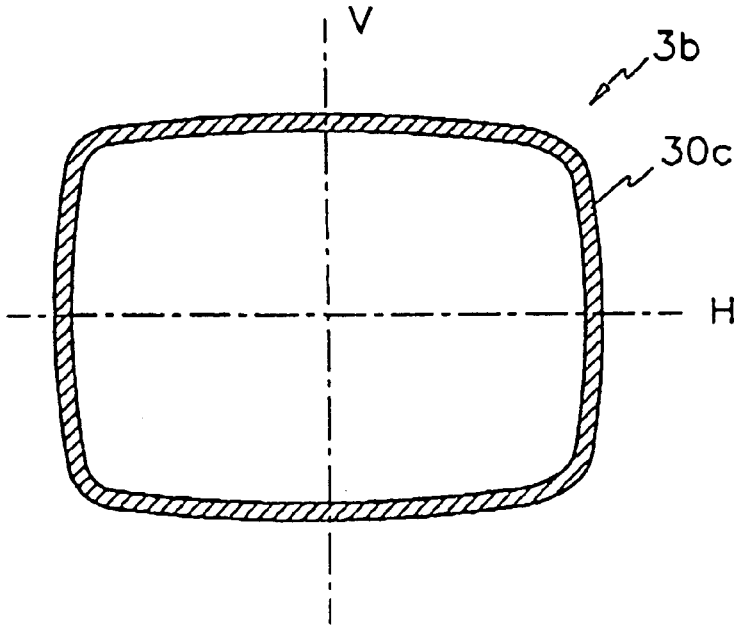
FIG. 4 is a sectional view of a cone portion of a funnel for a CRT according to a second preferred embodiment of the present invention.

FIGS. 3 and 4 are views illustrating a cone portion of a funnel for a CRT according to a second preferred embodiment of the present invention. In this preferred embodiment, the overall components of the CRT are the same as those related to the first preferred embodiment except that the cone portion 3*b* of the funnel 3 is formed with a sectional shape varying from a circle to a non-circle while proceeding from the small sized end to the large sized end.

As shown in FIG. 3, the small-sized end 30*d* of the cone portion 3*b* sealed to the neck 5 has a substantially circular sectional shape such that it has a diameter identical with that of the neck 5. In contrast, as shown in FIG. 4, the large-sized end 30*c* of the cone portion 3*b* has a non-circular sectional shape like a rectangle.

As is in the first preferred embodiment, the funnel 3 having the cone portion 3*b* according to this preferred embodiment is structured to satisfy the above-identified condition, i.e., $1.16 \leqq ((D/2)/\tan(\psi/2))/(FG-TN) \leqq 1.35$.

In order to compare performance characteristics of the CRT according to the second preferred embodiment of the present invention with those of the conventional CRT, CRTs having the structural components listed in Table 2 were tested with respect to their deflection efficiency (DE) and beam shadow neck (BSN) characteristics, and the results are illustrated in Table 2.

TABLE 2

| No. | D (inch) | ϕ (°) | FG (mm) | TN (mm) | V | DE | BSN |
|---|---|---|---|---|---|---|---|
| 1 | 18 | 100 | 204 | 76 | 1.50 | ⊙ | X |
| 2 | 18 | 100 | 214 | 58 | 1.23 | ⊙ | ○ |
| 3 | 18 | 100 | 223 | 61 | 1.18 | ○ | ○ |
| 4 | 18 | 100 | 234 | 56 | 1.08 | X | ⊙ |

As is in the first preferred embodiment, the CRTs having the above-identified characteristics (Nos. 2 and 3) exhibit good performance characteristics compared to conventional CRTs (Nos. 1 and 4). Furthermore, in the CRTs according to a second preferred embodiment of the present invention (Nos. 2 and 3), the overall CRT length can be effectively reduced.

Accordingly, the CRT can effectively enhance electron beam deflection efficiency with minimized deflection power.

While the present invention has been described in detail with reference to the preferred embodiments, those skilled in the art will appreciate that various modifications and substitutions can be made thereto without departing from the spirit and scope of the present invention as set forth in the appended claims.

This application claims priority of Korean Application No. 98-48061 filed Oct. 11, 1998 in the Korean Industrial Property Office, the content of which is incorporated herein by reference.

What is claimed is:

1. A cathode ray tube comprising:

a panel having an inner phosphor screen and a rear portion;

a funnel connected to the rear portion of the panel, the funnel sequentially having a body with a large-sized end and a small-sized end, and a cone portion with a large-sized end and a small-sized end, the large-sized end of the body being sealed to rear portion of the panel, the small-sized end of the body meeting the large-sized end of the cone portion at a point, the meeting point of the body and the cone portion being an inflection point of the funnel;

a neck sealed to the small-sized end of the cone portion;

an electron gun fitted within the neck to produce electron beams, the electron gun having a final accelerating electrode; and a deflection yoke mounted around the cone portion of the funnel;

wherein the funnel is structured to satisfy the following condition:

$$1.16 \leqq ((D/2)/\tan(\Phi/2))/(FG-TN) \leqq 1.35$$

where D indicates the size of an effective area of the phosphor screen, FG indicates the distance between the large-sized end of the body and the final accelerating electrode of the electron gun, TN indicates the distance between the small-sized end of the cone portion and the inflection point of the funnel, and Φ indicates the electron beam deflection angle.

2. The cathode ray tube of claim 1 wherein the effective screen size D is 17 inch or more, and the electron beam deflection angle is 100 degree or more.

3. The cathode ray tube of claim 1 wherein the cone portion has a substantially circular sectional shape uniformly proceeding from large-sized end to the small-sized end.

4. The cathode ray tube of claim 1 wherein the cone portion has a sectional shape varying from a circle to a non-circle while proceeding from the small-sized end to the large-sized end.

5. A cathode ray tube comprising:

a panel having an inner phosphor screen and a rear portion;

a funnel having a body with a first end connected to the rear portion of the panel, and a cone portion having a first end coupled to a second end of the body at an inflection point of the funnel;

a neck coupled to a second end of the cone portion;

an electron gun disposed within the neck to produce electron beams, the electron gun having a final accelerating electrode; and a deflection yoke mounted around the cone portion of the funnel;

wherein the funnel structure satisfies the following condition:

$$1.16 \leqq ((D/2)/\tan(\psi/2))/(FG-TN) \leqq 1.35$$

where D is a diagonal of an effective area of the phosphor screen, FG is a distance between the first end of the body and the final accelerating electrode of the electron gun, TN is a distance between the second end of the cone portion and the inflection point of the funnel, and ψ is an electron beam deflection angle.

6. The cathode ray tube of claim 5 wherein the minimum diagonal D is 17 inches, and the minimum electron beam deflection angle is 100 degrees.

7. The cathode ray tube of claim 5 wherein the cone portion has a substantially circular cross-section.

8. The cathode ray tube of claim 5 wherein the cone portion has a cross-section which varies from circular at the second end to non-circular at the first end.

9. The cathode ray tube of claim 8 wherein the cross-section of the first end of the cone portion is rectangular.

* * * * *